US010028563B2

(12) United States Patent
Choi

(10) Patent No.: US 10,028,563 B2
(45) Date of Patent: Jul. 24, 2018

(54) CAP FOR COSMETIC BOTTLE

(71) Applicant: Jong-Suh Choi, Hwaseong-si (KR)

(72) Inventor: Jong-Suh Choi, Hwaseong-si (KR)

( * ) Notice: Subject to any disclaimer, the term of this patent is extended or adjusted under 35 U.S.C. 154(b) by 0 days.

(21) Appl. No.: 14/972,863

(22) Filed: Dec. 17, 2015

(65) Prior Publication Data

US 2016/0100668 A1 Apr. 14, 2016

Related U.S. Application Data

(62) Division of application No. 13/591,688, filed on Aug. 22, 2012, now Pat. No. 9,237,793.

(30) Foreign Application Priority Data

Sep. 23, 2011 (KR) ..... 10-2011-0096277
Dec. 1, 2011 (KR) ..... 10-2011-0127633

(51) Int. Cl.
*A45D 34/00* (2006.01)
*A45D 34/04* (2006.01)
*B05B 11/00* (2006.01)

(52) U.S. Cl.
CPC ..... *A45D 34/00* (2013.01); *A45D 34/04* (2013.01); *B05B 11/3007* (2013.01); *B05B 11/3047* (2013.01); *A45D 2034/002* (2013.01)

(58) Field of Classification Search
CPC .. A45D 34/00; A45D 34/04; A45D 2034/002; B05B 11/3047; B05B 11/3005; B05B 11/3007; B05B 11/3008
See application file for complete search history.

(56) References Cited

U.S. PATENT DOCUMENTS 3,101,751 A * 8/1963 Ballin ..... B01L 3/0282 141/24
4,016,765 A * 4/1977 Lee ..... B01L 3/0224 222/50
4,579,153 A * 4/1986 Goncalves ..... B01L 3/0282 141/23
5,669,530 A * 9/1997 Cichon ..... B05B 11/0013 222/153.09
6,164,498 A * 12/2000 Faughey ..... B05B 11/3008 222/153.13

(Continued)

*Primary Examiner* — Timothy L Maust
*Assistant Examiner* — Andrew Stclair
(74) *Attorney, Agent, or Firm* — Novick, Kim & Lee, PLLC; Jae Youn Kim

(57) ABSTRACT

Disclosed is a cap for a cosmetic bottle. The cap for the cosmetic bottle includes a coupling member provided at the upper end thereof with a plurality of moving bars, a button member provided at an inner surface thereof with a plurality of moving grooves so that the moving bars are vertically inserted into the moving grooves, a pumping part being coupled with a lower end of a pumping member, an elastic member interposed between the coupling member and the button member, a rotating member rotatably coupled with an outside of the coupling member, an adjusting member rotatably inserted into an inner surface of an upper end of the rotating member, a button member outputting unit to allow the button member to vertically move up or down if the rotating member is rotated, and a coupling unit to couple the rotating member with the coupling member or the adjusting member.

1 Claim, 19 Drawing Sheets

(56) References Cited

U.S. PATENT DOCUMENTS

| | | | | |
|---|---|---|---|---|
| 6,770,056 | B2 * | 8/2004 | Price | G01F 11/023 222/43 |
| 2011/0284123 | A1 * | 11/2011 | Bouix | A45D 34/04 141/23 |

* cited by examiner

CAP FOR COSMETIC BOTTLE

BACKGROUND OF THE INVENTION

1. Field of the Invention

The present invention relates to a cap for a cosmetic bottle. In particular, the present invention relates to a cap for a cosmetic bottle, in which a consumer can personally adjust an amount of a solution contained in the cosmetic bottle to a necessary extent and can use only the required amount of the solution according to the necessary extent.

In addition, when a cap is coupled with the cosmetic bottle so that the cosmetic bottle is closed, a button member is hidden, so that a fine outer appearance of the cosmetic bottle is formed. When the cosmetic bottle is open, the button member appears while the pipette is sucking the cosmetic solution.

In addition, according to the cap of the cosmetic bottle of the present invention, a user can personally adjust and set a required amount of cosmetics to be once-used, thereby minimizing the waste of a surplus cosmetic solution occurring as amounts of cosmetics to be used once are different according to users.

2. Description of the Related Art

In general, women wear makeup so that their faces are shown gorgeously and beautifully.

Cosmetics may be classified into basic cosmetics, makeup cosmetics, cosmetics for hair, fragrances, and functional cosmetics. The cosmetics are classified into cream type cosmetics, powder type cosmetics, or liquid-phase type cosmetics according to the states thereof, and stored in vessels suitable for the state of thereof.

The cosmetic vessel receives basic cosmetics, makeup cosmetics, or functional cosmetics so that a consumer can conveniently use the cosmetics.

In general, the basic cosmetics are received in a basic vessel having a narrow or wide entrance. In contrast, since the functional cosmetics are extremely slightly used and high-priced, the vessel of the function cosmetics is made a great difference from a typical cosmetic vessel in terms of the cap structure as well as the directions for the cosmetic vessel so that the functionality of the function cosmetics can be ensured.

In other words, most function cosmetics such as an eye cream are received in a vessel having the form of an extruded tube. The cosmetic vessel having the form of the extruded tube does not require the fine adjustment in the amount of cosmetics to be used. In addition, since the cosmetics received in the cosmetic vessel having the form of the extruded tube are low-priced products, a user may not be greatly careful in relation to the used amount of cosmetics. Accordingly, even if the cosmetics are received in the extruded tube, a great influence is not exerted on marketing and public relations.

In other words, when the functional cosmetics received in the extruded tube are almost consumed, the extrusion pressure of the extruded tube is greatly reduced. Accordingly, even if a user discards the extruded tube having extra cosmetics, the user is not reluctant to discard the extruded tube having extra cosmetics.

In addition, after most cosmetics received in the extruded tube have been primarily discharged on a hand of a user, the cosmetics are secondarily applied to the hand or a body part of the user. Accordingly, the user is not greatly reluctant to waste the slight amount of cosmetics that may occur according to the used amount and the directions for the cosmetics as described above.

However, functional cosmetics are produced and sold at a high price. Accordingly, if a user does not directly apply the functional cosmetics to a target, but applies the functional cosmetics to the target after applying primarily the cosmetics to the hand of the user, since most functional products have volatility, the function cosmetics may be wasted from the time point at which the user applies the cosmetics to the hand of the user. Accordingly, it is natural that the consumer using the high-priced product seriously thinks the problems related to the functional cosmetics.

Therefore, in order to solve the above problem, according to the related art, in the case of high-priced cosmetics, especially, cosmetics having the form of a solution or liquid-phase cosmetics, a pipette separately provided from the cosmetic vessel or a pipette integrally formed with the cosmetic vessel is provided, so that only the required amount of cosmetics can be directly applied to a target through the pipette.

However, according to the enhanced method of the related art, in order to use the solution received in the cosmetic vessel, a consumer personally carries out a pumping operation to press a press member to use the solution received in the cosmetic vessel. Accordingly, since a slight amount of solution or a great amount of solution may be introduced into the pipette, another cosmetic waste problem may occur.

In addition, the amount of cosmetics sucked into the pipette may be varied according to the method of using the cosmetics, the taste, or the habit of the user using the high-priced cosmetics.

In other words, on the assumption that an amount of cosmetics once sucked into the pipette is 1, the amount of cosmetics used by a predetermined consumer may be 1, the amount of cosmetics used by another consumer may be ½, and the amount of cosmetics used by still another consumer may be ⅓. Accordingly, a consumer using cosmetics having an amount less than 1 unintentionally may use cosmetics remaining in the pipette. Accordingly, the consumer may regard the unexpected use of the cosmetics as the waste of the cosmetics.

SUMMARY OF THE INVENTION

Accordingly, the present invention has been made keeping in mind the above problems occurring in the prior art, and an object of the present invention is to provide a cap for a cosmetic bottle, in which a user can personally adjust an used amount of cosmetics to a necessary extent so that only a required amount of cosmetics can be discharged, thereby preventing the cosmetics from being unnecessarily wasted. In particular, the required amount of cosmetics can be sucked into a pipette through only an operation of separating a cap from the cosmetic bottle. In addition, a once-used amount of cosmetics can be adjusted for each consumer by reflecting the fact that the amounts of cosmetics to be used once are varied according to consumers.

In order to accomplish the above objects, according to one aspect of the present invention, there is provided a cap for a cosmetic bottle including an opening/closing member (103) including a bottle coupling part (101) having an inner surface which is provided in a shape of a cap having a ⊓-shaped sectional surface and provided thereon with a thread part so that the cap thread part (201) is threaded with an upper end of the cosmetic bottle, and a body coupling part (102) upwardly erected with a predetermined height after extending by a predetermined distance from an outer circumference of an lower end of the bottle coupling part (101), an adjusting member (105) rotatably coupled with an upper end of a cylindrical body (104) coupled with an outer surface of the body coupling part (102) and having an upper end provided therein with a second through hole (105*a*), a press button (106) provided in the shape of the cap having the ⊓-shaped sectional surface and inserted from a lower portion of the second through hole (105*a*) to an upper portion of the second through hole (105*a*) so that the press button (106) is exposed, a pumping tube (107) provided in the shape of the cap having a ⊓-shaped sectional surface, provided in an outer circumference thereof with a coupling groove (107*a*) so that the coupling groove (107*a*) is fitted around an inner circumference part of the first through hole (101*a*), provided around a lower portion of an inner surface thereof with a fitting groove (107*b*), having a bellows-structured upper portion to vertically extract or contract as the press button (106) is moved up or moved down in a state that an upper end of the pumping tube (107) makes contact with a bottom surface of the press button (106), a pipette (108) having a tubular structure and having a fitting protrusion (108*a*) protruded on an outer surface of an upper end of the pipette (108) and fitted into the fitting groove (107*b*) of the pumping tube (107), and an adjusting unit of the press button (106) to adjust an ascending distance or a descending distance of the press button (106).

According to the present invention, the adjusting unit of the press button (106) includes a support part (303) including a plurality of horizontal support steps (301), which are protruded clockwise or counterclockwise in a circumferential direction on an outer circumference part of a lower portion of the press button (106) and spaced apart from each other by a predetermined distance, and have a predetermined height, and a support guide (302) molded while being inclined at a predetermined angle and connecting the support steps (301) to each other, and a locking part (313) including a plurality of horizontal locking steps (311), which are downwardly protruded counterclockwise or clockwise in a circumferential direction on a lower portion of the second through hole (105*a*) of the adjusting member (105) and spaced apart from each other by a predetermined distance, and have a predetermined height, and a locking guide (312) molded while being inclined at a predetermined angle and connecting the locking steps (311) to each other, so that the locking part 313 is toothed with an upper portion of the support part (303) of the press button (106).

According to another aspect of the present invention, there is provided a cap for a cosmetic bottle including an opening/closing member (103) including a bottle coupling part (101) having an inner surface which is provided in a shape of a cap having a ⊓-shaped sectional surface and provided thereon with a thread part so that the cap thread part (201) is threaded with an upper end of the cosmetic bottle, and a body coupling part (102) upwardly erected with a predetermined height after extending by a predetermined distance from an outer circumference of an lower end of the bottle coupling part (101), an adjusting member (105) rotatably coupled with an upper end of a cylindrical body (104) coupled with an outer surface of the body coupling part (102) and having an upper end provided therein with a second through hole (105*a*), a press button (106) provided in the shape of the cap having the ⊓-shaped sectional surface and inserted from a lower portion of the second through hole (105*a*) to an upper portion of the second through hole (105*a*) so that the press button (106) is exposed, an elastic member (110) provided onto an outer surface of the bottle coupling part (101) to elastically support a bottom surface of the press button (106), a cylinder (111) provided in an outer circumference surface of a lower portion thereof with a coupling groove 107*a* fitted around an inner circumference part of the first through hole (101*a*) and provided in a lower portion of an inner circumference surface thereof with a fitting groove (107*b*), a guide rod (112) protruded downward from a bottom surface of the press button (106), a piston (113) coupled with a lower end of the guide rod (112) to elastically and densely make contact with the inner circumference surface of the cylinder (111), a pipette (108) having a tubular structure and having a fitting protrusion (108*a*) protruded on an outer surface of an upper end of the pipette (108) and fitted into the fitting groove (107*b*) of the pumping tube (107), and an adjusting unit of the press button (106) to adjust an ascending distance or a descending distance of the press button (106).

According to the present invention, the adjusting unit of the press button (106) includes a support part (303) including a plurality of horizontal support steps (301), which are protruded clockwise or counterclockwise in a circumferential direction on an outer circumference part of a lower portion of the press button (106) and spaced apart from each other by a predetermined distance, and have a predetermined height, and a support guide (302) molded while being inclined at a predetermined angle and connecting the support steps (301) to each other, and a locking part (313) including a plurality of horizontal locking steps (311), which are downwardly protruded counterclockwise or clockwise in a circumferential direction on a lower portion of the second through hole (105*a*) of the adjusting member (105) and spaced apart from each other by a predetermined distance, and have a predetermined height, and a locking guide (312) molded while being inclined at a predetermined angle and connecting the locking steps (311) to each other, so that the locking part 313 is toothed with an upper portion of the support part (303) of the press button (106).

According to still another aspect of the present invention, there is provided a cap for a cosmetic bottle including a coupling member (510) provided on an inner surface thereof with a cap thread part (501) to be coupled with a bottle thread part (100*a*) provided at an upper end of the cosmetic bottle (100), having an upper end of the inner surface coupled with an upper end of a pipette (502), provided at an upper end thereof with a cylindrical pumping tube (3) upward extending by a predetermined length so that the pumping tube (3) communicates with the inner surface, and provided at the upper end thereof with a plurality of moving bars (504) which are protruded in a circumferential direction, a button member (520) having a stage-type cap (n) appearance and provided at an inner surface thereof with a plurality of moving grooves (511) formed in a circumferential direction so that the moving bars 504 are vertically inserted into the moving grooves (511), a pumping part (513) being coupled with a lower end of a pumping member (512) protruded downward from a bottom surface of the button member (520) so that the pumping part (513) slides on an inner surface of a pumping tube (503) while densely making contact with on the inner surface of the pumping tube (503), an elastic member (530) interposed between the coupling member (510) and the button member (520) and having elasticity, a rotating member (540) having a shape of a cylinder having a predetermined height and rotatably coupled with an outside of the coupling member (510), an adjusting member (550) rotatably inserted into an inner surface of an upper end of the rotating member (540) and coupled with the inner surface of the upper end of the rotating member (540), provided therein with a through hole (551) to allow the button member (520) to pass therethrough, and preventing the button member (520) from being out of the through hole (551) by the elasticity of the elastic member (530), a button member outputting unit to allow the button member (520) to vertically move up or move down as the coupling member (510) is coupled to a bottle thread part (100*a*) or released from the bottle thread part (100*a*) by rotating the rotating member (540), and a coupling unit to couple the rotating member (540) with the coupling member (510), and to couple the rotating member (54) with the adjusting member (550).

According to the present invention, there is provided the button member outputting unit includes a plurality of locking parts (505) protruding outward from an outer diameter of the coupling member (510), a plurality of support parts (531) protruded inward from an upper portion of an inner surface of the rotating member (540) and interfering with the locking parts (505), at least adjusting groove (514) formed in any one of end portions of the button member (520) having the stage-type cap (n) appearance and having an inclined surface having an area gradually reduced downward, and an adjusting protrusion (532) protruded on an inner surface of an upper portion of the rotating member (540) so that the adjusting protrusion (532) is inserted into the adjusting groove (514) corresponding to the adjusting groove (514) and having an inclined surface having an area gradually reduced downward.

According to the present invention, the coupling unit includes coupling grooves (533) formed at upper and lower end portions of an inner surface of the rotating member (540), and hooks (506) protruding from a lower end portion of an outer surface of the coupling member (510) and protruding from a lower end portion of an outer surface of the adjusting member (550).

Preferably, according to the present invention, the cap for the cosmetic bottle further includes at least one adjusting groove (515) formed in any one of end portions of the button member 520 having the stage-type cap (n) appearance and having an inclined surface having an area gradually reduced downward, and an adjusting protrusion (552) protruding downward from a lower portion of the adjusting member (550) so that the adjusting protrusion (552) is inserted into the adjusting groove (515) corresponding to the adjusting groove (515) and having an inclined surface having an area gradually reduced downward.

Preferably, according to the present invention, a horizontal part connected to the inclined surface of the adjusting groove (514), the adjusting protrusion (532), the adjusting groove (515) or the adjusting protrusion (552) is smoothly rounded.

As described above, according to the present invention, if the cap is coupled with the cosmetic bottle, the internal air of a pipette compresses the internal air of the cosmetic bottle. When the cap is separated from the cosmetic bottle, the compressed air returns to air having normal density. In this process, the required amount of a solution is sucked into the pipette. Accordingly, without the unnecessary operation of sucking the solution into the pipette in the state that the cap is separated, the user instantly can use the required amount of cosmetics.

The ascending distance or the descending distance of the button member is adjusted, so that a slight amount of the solution is sucked into the pipette if the ascending distance or the descending distance is short when the cap is coupled with the bottle, and a great amount of the solution is sucked into the pipette if the ascending distance or the descending distance is long. Accordingly, the user can adjust the required amount of the solution introduced into the pipette according to the cosmetic use habit or the cosmetic taste of the user.

Therefore, in the case of a user using a slight amount of cosmetics when the user uses the cosmetics once, the required amount of cosmetics suitable for the user can discharged. Accordingly, the user may not use an unnecessarily remaining amount of cosmetics. Therefore, the burden of the user related to the unnecessary use of the cosmetics and the overuse of the cosmetics can be reduced.

DETAILED DESCRIPTION OF THE INVENTION

The present invention relates to a cap for a cosmetic bottle 100 allowing a user to suction liquid-phase cosmetics or cosmetics having the form of a solution contained in the cosmetic bottle 100 by using a pipette 108 and personally apply the liquid-phase cosmetics or the cosmetics made of the solution to an affected part of the user.

Hereinafter, the cap for the cosmetic bottle 100 according to the first embodiment of the present invention will be described with reference to FIGS. 1 to 4.

Figure 4:
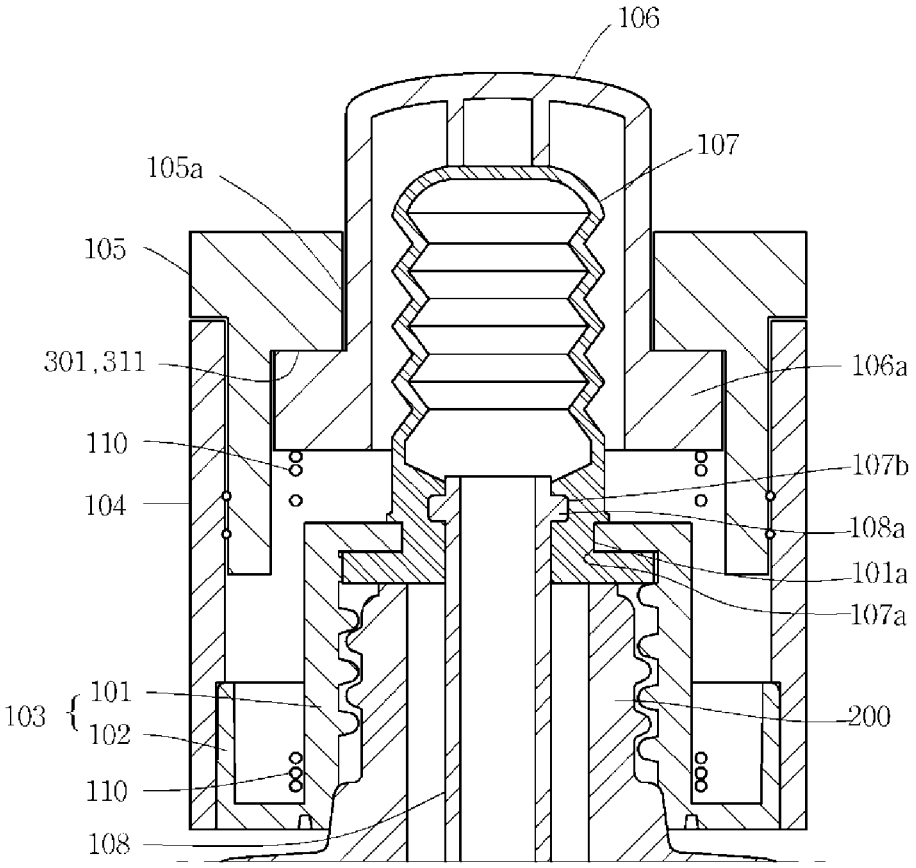
FIG. 4 is a sectional view showing a cap for a cosmetic bottle according to a first embodiment of the present invention.

In other words, as shown in FIG. 4, similarly to the structure of a typical cap for the cosmetic bottle 100, an opening/closing member 103 to open/close the cosmetic bottle 100 is coupled with an upper end of the cap for the cosmetic bottle 100 by using a screw.

In this case, the opening/closing member 103 includes a bottle coupling part 101 and a body coupling part 102. The bottle coupling part 101 is provided in an upper end thereof with a first through hole 101*a* so that the first through hole 101*a* is coupled with the pipette 108 which will be described below. In addition, the bottle coupling part 101 includes a cap thread part 201 threaded with the upper end of the bottle 100.

The body coupling part 102 is erected with a predetermined height in a tubular structure extending upward from an end portion of a flange 102*a* which extends by a predetermined distance in a circumferential direction from an outer circumference of a lower end of the bottle coupling part 101.

In addition, a body 104 having a cylindrical shape is press fitted into an outer circumference of the body coupling part 102 or coupled with the body coupling part 102 by using a screw. An adjusting member 105 is rotatably coupled with the upper end of the body 104 as shown in FIG. 4.

The adjusting member 105 is provided at an upper end thereof with a second through hole 105*a* and provided in the shape of a cap having a ⊓-shaped sectional surface, and assembled as shown in FIG. 4 in such a manner that a press button 106 passes through the second through hole 105*a* upward from a lower portion of the second through hole 105*a*.

Hereinafter, the structure of the press button 106 will be described with reference to FIGS. 2 and 3.

The press button 106 is assembled while passing through the second through hole 105*a* upward from the lower portion of the second through hole 105*a*. Accordingly, in order to prevent the press button 106 from being out of an upper portion of the second through hole 105*a*, a flange 106*a* is generally molded at a lower portion of the press button 106 so that the flange 106*a* interferes with the second through hole 105*a*, thereby preventing the press button 106 from being out of the second through hole 105*a*.

Figure 2:
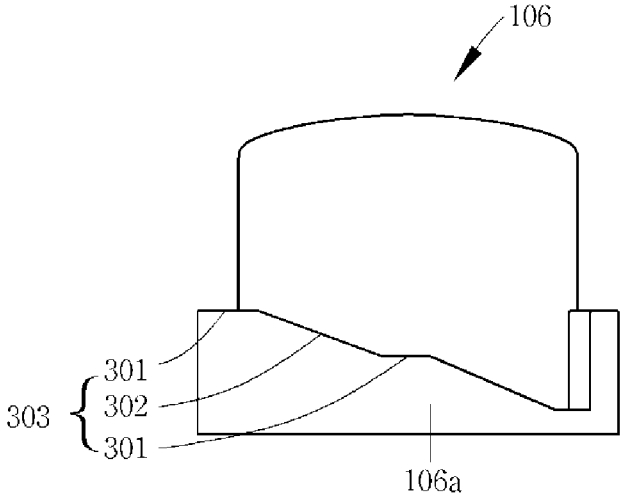
FIG. 2 is a side view showing a press button according to the present invention.

According to the present invention, as shown in FIG. 2, a plurality of horizontal support steps 301 are protruded with predetermined interval and height on the lower portion of the outer circumference surface of the press button 106. The horizontal support steps 301 are connected to support guides 302, which protrude while being inclined at a predetermined angle as shown in FIG. 2 to construct a support part 303. Accordingly, the support part 303 can serve as the flange 106*a* of the press button 106 as shown in FIG. 2.

In this case, two support steps 301 must be molded in total so that the support steps 301 are provided to at least upper and lower portions of the support part 303, respectively. When at least two support steps 301 are molded, the adjustment of the sucked amount of cosmetic by the pipette 108 using the press button 106 and the adjusting member 105.

Figure 1:
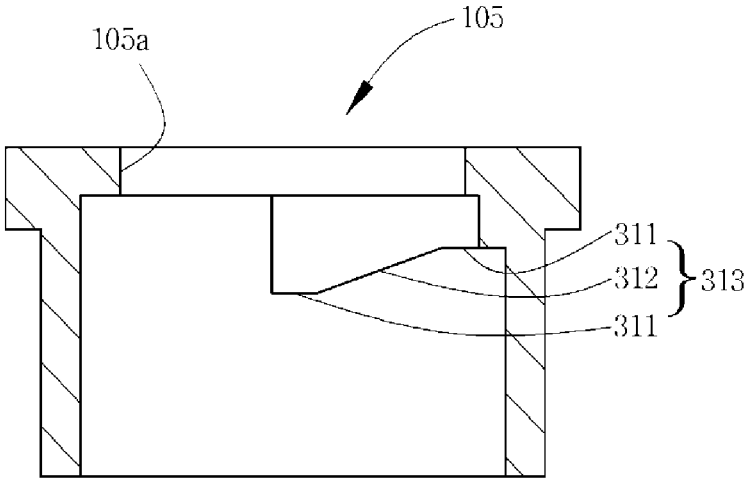
FIG. 1 is a sectional view showing an adjusting member according to the present invention.
Figure 3:
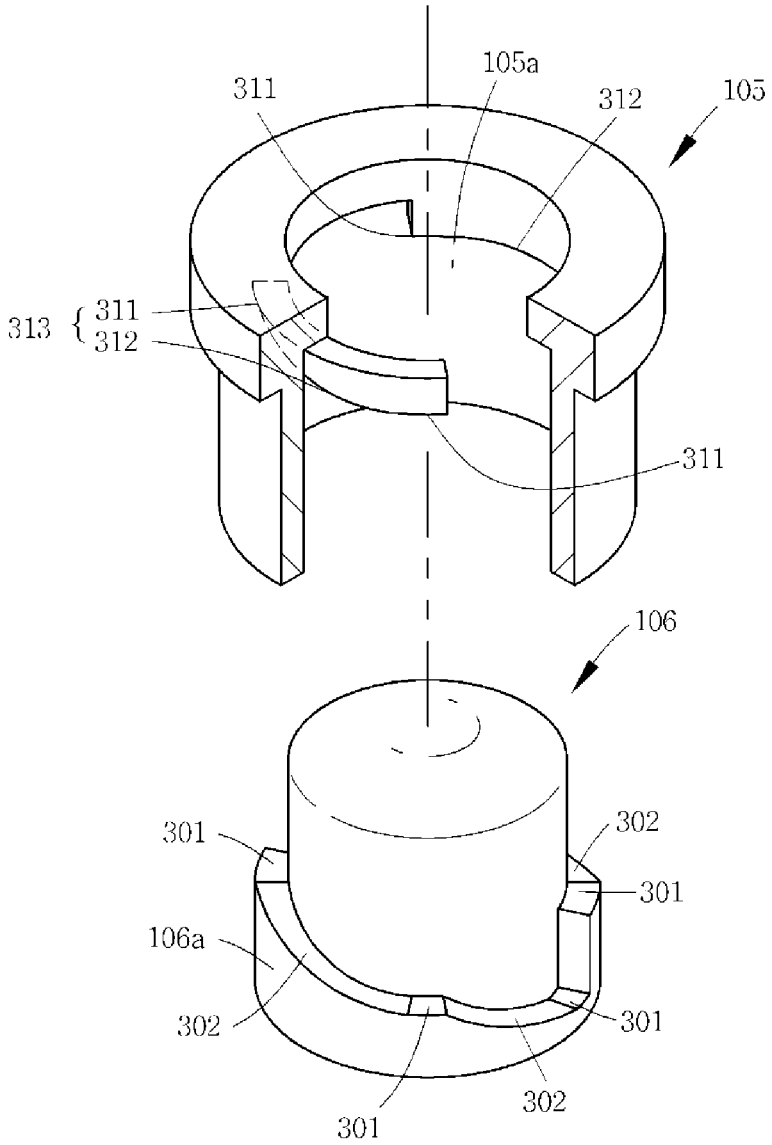
FIG. 3 is a partial cut-away perspective view showing the coupling structure of the adjusting member and the press button according to the present invention.

Meanwhile, as shown in FIGS. 1 and 3, and FIG. 4, a plurality of horizontal locking steps 311 are protruded with predetermined interval and height at a lower portion of the second through hole 105*a* of the adjusting member 105 corresponding to the support part 303 of the press button 106, and a locking part 313, in which the locking steps 311 are connected to a locking guide 312 protruded while being inclined at a predetermined angle as shown in drawings, is molded, so that the support part 303 of the press button 106 may be toothed with the locking part 313 of the adjusting member 105.

Accordingly, if the support step 301 of the support part 303 is formed in a direction in which the support part 303 ascends counterclockwise, and the support guide 302 is connected to the support step 301 at an angle in which the support guide 302 ascends, only if the locking step 311 of the locking part 313 must be formed in a direction in which the locking part 313 descends clockwise and the locking guide 312 must be obliquely connected to the support step 301 at an angle in which the locking guide 312 descends, the support part 303 may be toothed with the locking part 313 as shown in FIG. 3.

Meanwhile, as shown in FIG. 4, the press button 106 is provided at the lower portion thereof with a pumping tube 107 having a bellows-structured upper portion and having a ⊓-shaped sectional surface so that the bottom surface of the press button 106 makes contact with an upper end of the pumping tube 107. As shown in FIG. 4, a coupling groove 107*a* is formed on an outer circumference surface of a lower portion of the pumping tube 107, so that the coupling groove 107*a* is fitted around an inner circumference part of the first through hole 101*a*, so that the pumping tube 107 is coupled with the opening/closing member 103.

In addition, the pumping tube 107 is provided in a predetermined position of an inner surface thereof with a fitting groove 107*b*. A fitting protrusion 108*a*, which is protruded from an outer surface of an upper end of the pipette 108, is fitted into the fitting groove 107*b*, so that the pipette 108 can be coupled with the pumping tube 107.

If the opening/closing member 103 including the body coupling part 102 and the bottle coupling part 101 is coupled with an upper end of the cosmetic bottle by rotating the body 104, the press button 106 descends to press the bellows structure of the pumping tube 107 while introducing air contained in the pipette 108 into the cosmetic bottle 100. Thereafter, the air of the pipette 108 is mixed with internal air of the cosmetic bottle 100 as shown in FIG. 5*b*.

In this case, the internal air pressure of the cosmetic bottle 100 is maintained in a high pressure state. When the opening/closing member 103 is gradually separated from an upper end of the cosmetic bottle 100 by rotating the body 104, the press button 106 is moved up due to the elasticity of the bellows structure of the press button 106 or the elasticity of an elastic member 110 which is inserted into a space (the upper portion of the flange 102) between an outer surface of the bottle coupling part 101 and the body coupling part 102 as shown in FIG. 4 to elastically support the press button 106. Simultaneously, a cosmetic liquid is sucked into the pipette 108 due to the pressure difference inside the cosmetic bottle 100.

Meanwhile, an adjusting unit of the press button 106 is realized by the adjusting member 105 and the press button 106. In the coupling structure shown in FIG. 4, if the adjusting member 105 is rotated at a predetermined angle, the locking step 311 of the locking part 313 of the adjusting member 105 slides along the support guide 302 of the support part 303 of the press button 106. Regarding the locking step 311 sliding along the support guide 302, since force to moving up the press button 106 is applied to the press button 106 due to the elasticity of the elastic member 110 or the bellows of the pumping tube 107, if the adjusting member 105 is rotated, the adjusting member 105 is rotated while the press button 106 is being moved up and the locking step 301 slides along the support guide 302 of the support part 303 so that the locking step 31 is combined with the support step 301. At the moment that the locking step 31 is combined with the support step 301, the sliding of the locking step 31 is stopped.

In this case, if the adjusting member 105 is rotated in an opposition direction, since the support guide 302 of the press button 106 is inclined at a predetermined inclination angle, the locking step 311 of the adjusting member 105 rotates while pushing the support guide 302 in a lateral direction. In this case, as the support guide 302 of the press button 106 rotates while making contact with the locking step 311, the support guide 302 descends.

Accordingly, if the support step 301 is toothed with the locking step 311 as described above, since the descending distance and the ascending distance of the press button 106 are determined by the support step 301 and the locking step 311, an amount of cosmetics sucked into the pipette 108 can be adjusted.

Meanwhile, a second embodiment according to the present invention is shown in FIGS. 5*a* to 6*c*.

First, the whole structure of the second embodiment is the same as that of the first embodiment.

In other words, since the structures of the opening/closing member 103, the body 104, the adjusting member 105, and the press button 106 are the same as those of the first embodiment, the details thereof will be omitted below except for a lower structure of the press button 106 and an upper pumping structure of the pipette 108.

The elastic member 110 may be further included according to the first embodiment. However, according to the first embodiment, since the pumping tube 107 has elasticity, even if the elastic member 110 is not provided, the operation of the first embodiment may be performed without problems. Although the elastic member 110 has been additionally described with the elastic member 110 in brief according to the first embodiment, since the second embodiment employs another pumping structure instead of the pumping tube 107 to suck the solution into the pipette 108, the second embodiment essentially requires the elastic member 110.

Figure 5A:
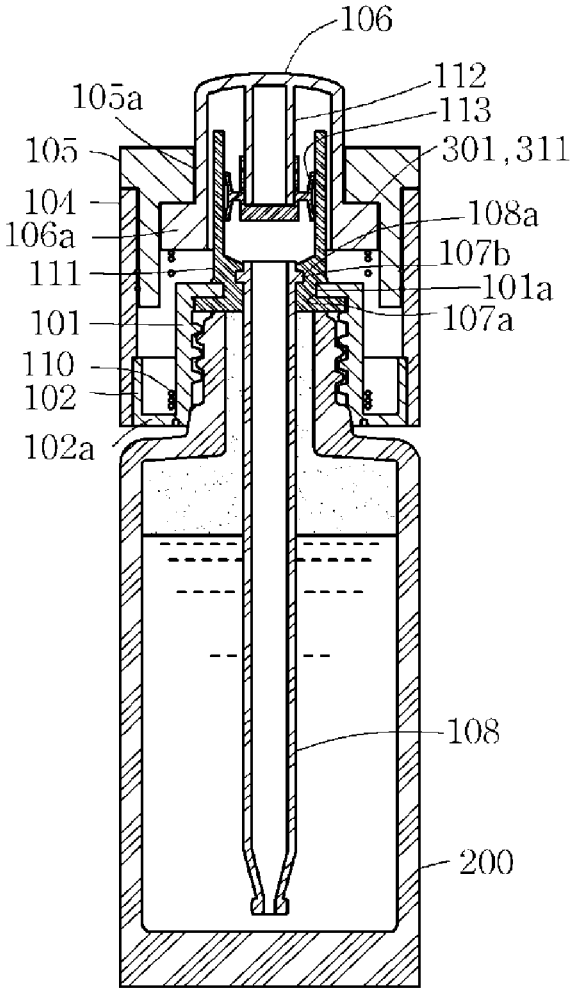
FIGS. 5*a* to 5*c* are sectional views showing the operation of the cap of the cosmetic bottle according to a second embodiment of the present invention when the ascending or descending stroke distance of the cap of the cosmetic bottle is short.
Figure 5B:
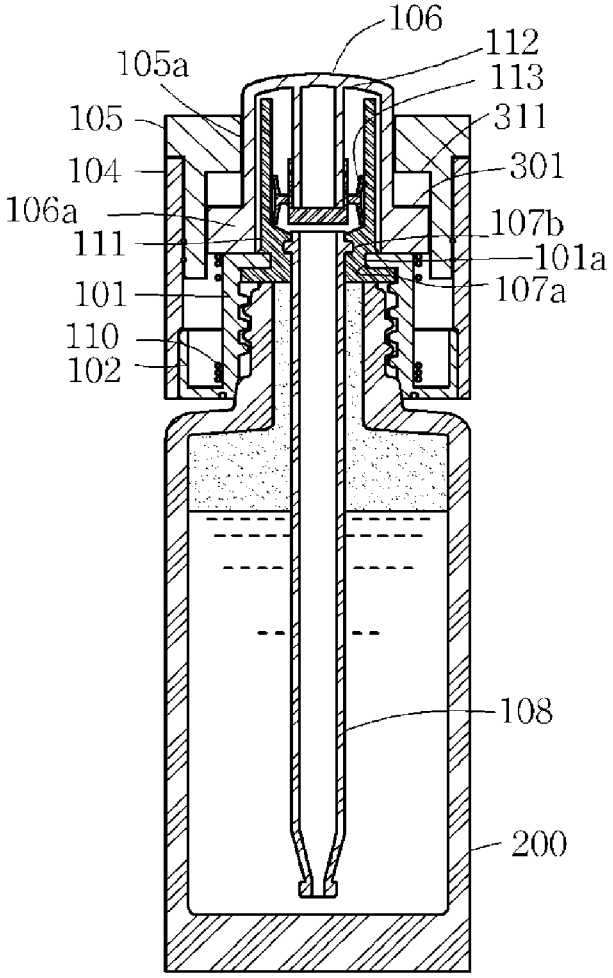
Figure 5C:
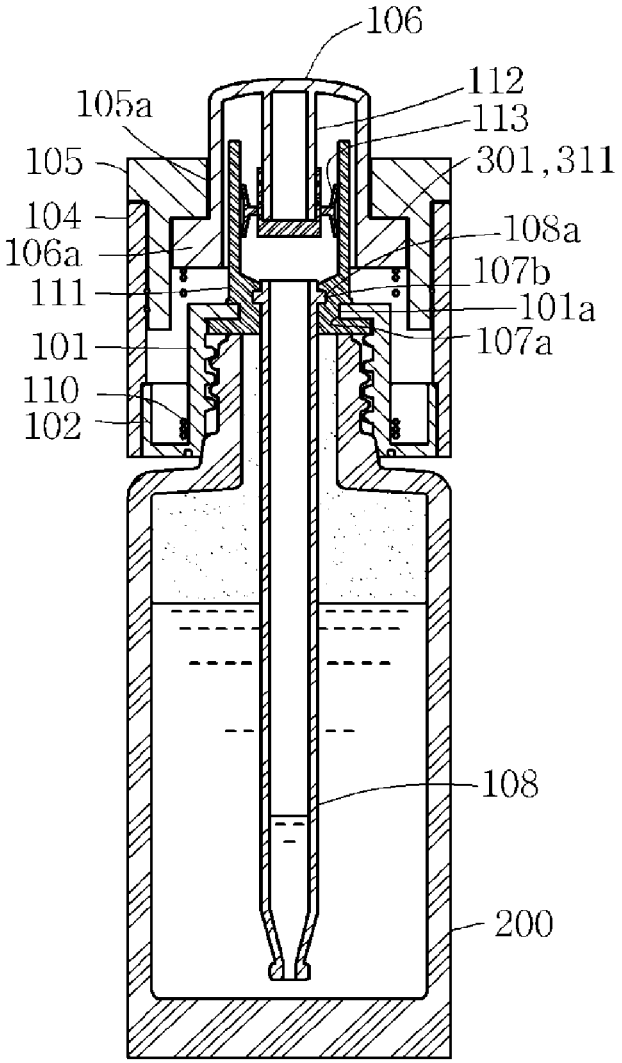
Figure 6A:
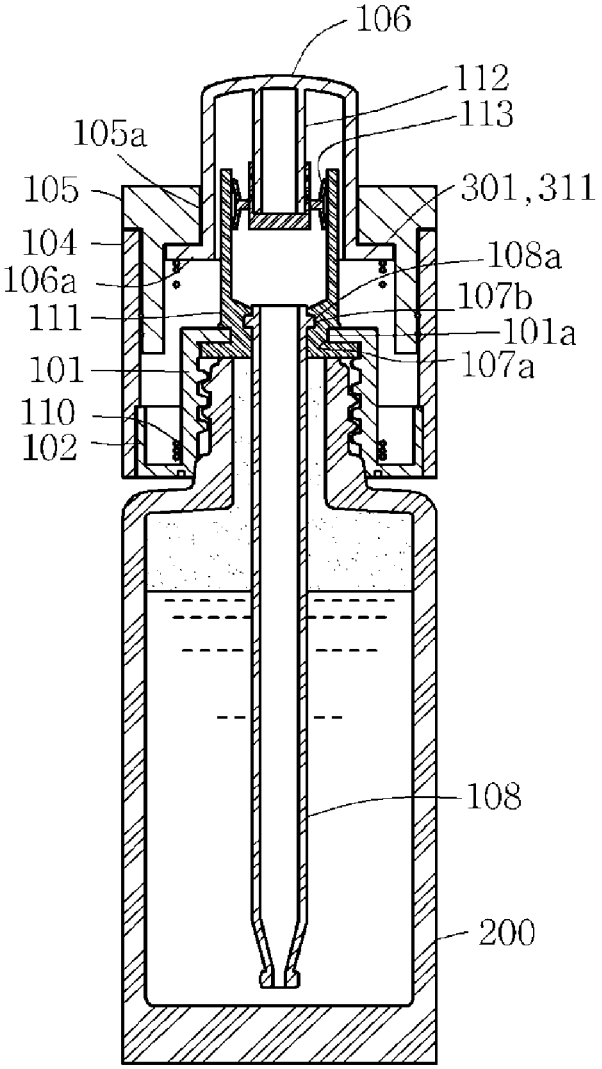
FIGS. 6*a* to 6*c* are sectional views showing the operation of the cap of the cosmetic bottle according to the second embodiment of the present invention when the ascending or descending stroke distance of the cap of the cosmetic bottle is long.
Figure 6B:
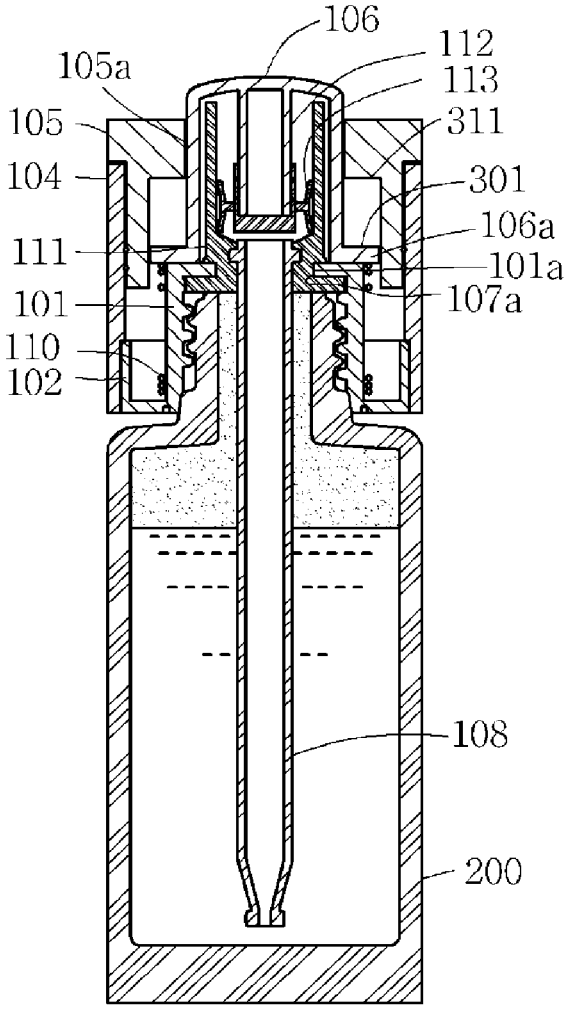
Figure 6C:
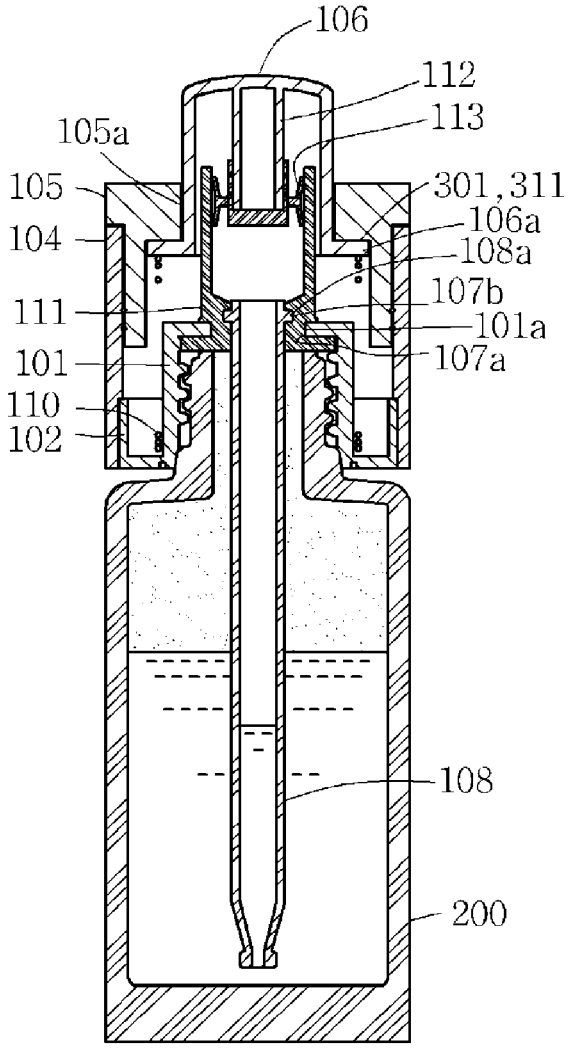

In other words, as shown in FIG. 5*a*, according to the pumping structure of the second embodiment, the coupling groove 107*a* formed in a lower portion of an outer surface of a cylinder 111 is fitted around an inner circumference part of the first through hole 101*a* formed in the upper end of the bottle coupling part 101 of the opening/closing member 103.

In addition, as shown in FIG. 5*a*, a guide rod 112 is protruded downward from the bottom surface of the press button 106, and a piston 113 is coupled with a lower end of the guide rod 112 so that the piston 113 may elastically support the circumference of an inner surface of the cylinder 111 or may densely makes contact with the circumference of the inner surface of the cylinder 111.

In addition, the fitting protrusion 108*a*, which is formed on the outer surface of the upper end of the pipette 108 provided in the shape of a tube, is fitted into the fitting groove 107*b* formed at the lower portion of the inner surface of the cylinder 111, so that the pipette 108 is coupled with the cylinder 111, and the piston 113 densely makes contact with the inner surface of the cylinder 111.

In this case, as shown in FIG. 5*a*, the elastic member 110 is provided onto an outer diameter of the bottle coupling part 101. In this case, a lower end of the elastic member 110 is seated on the flange 102*a* interposed between the bottle coupling part 101 and the body coupling part 102 of the opening/closing member 103, and an upper end of the elastic member 110 densely makes contact with the bottom surface of the press button 106, thereby applying the elasticity of the elastic member 110 to the press button 106 so that the press button 105 is elastically supported upward.

Meanwhile, the adjusting unit of the press button 106 according to the second embodiment of the present invention has the same structure as that of the support part 303, which is provided upward from the lower part of an outer surface of the press button 106, and the locking part 313, which is formed on the bottom surface of the second through hole 105*a* of the opening/closing member 103. Accordingly, the detail thereof will be omitted.

Therefore, if a consumer rotates the adjusting member 105 at a predetermined angle, the locking step 311 of the locking part 313 constituting the adjusting member 105 is rotated while pushing the support guide 302 of the support part 303 constituting the press button 106 in a lateral direction. In this case, the support guide 302 descends downward due to the interference of the locking step 311.

As a result, when the consumer presses the press button 106, the consumer may press the press button 106 which has already moved down by a predetermined distance. Accordingly, the descending distance of the press button 106 is reduced. In addition, if the press button 106 is moved up due to the elasticity of the elastic member 110 while sucking liquid after air has been compressed in the cosmetic bottle 100, the ascending distance of the press button 106 may be reduced by the locking part 313. Accordingly, an amount of liquid sucked by the pipette 108 is reduced.

In order to reduce the consumption of cosmetics as described above, the ascending and descending distances of the press button 106 are set to a short distance by rotating the adjusting member 105. In order to increase the consumption of cosmetics, the ascending and descending distances of the press button 106 are set to a long distance by rotating the adjusting member 105 in an opposition direction. Accordingly, a consumer can personally control an amount of the cosmetics.

A third embodiment of the present invention includes a coupling member 510, a button member 520, a rotating member 540, an adjusting member 550, and an elastic member 530.

Hereinafter, the structure of the coupling member 510 will be described with reference to FIGS. 11*a* to 11*c*.

Figure 11A:
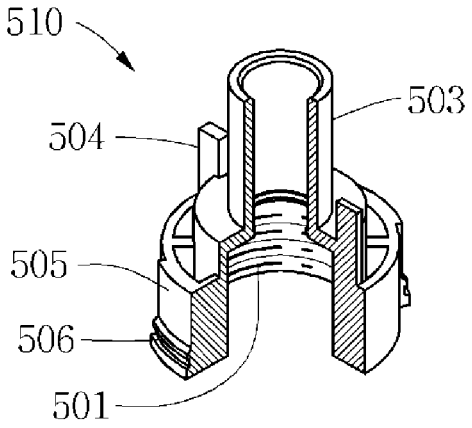
FIGS. 11*a* to 11*c* are views showing the structure of a coupling member according to the third embodiment of the present invention.

FIG. 11*a* is a partial cut-away perspective view showing the structure of the coupling member 510. A cap thread part 501 is formed on the inner surface of the coupling member 510, so that the cap thread part 501 is coupled with a bottle thread part 100*a* provided at an upper end of the cosmetic bottle 100 shown in FIG. 12.

Figure 11B:
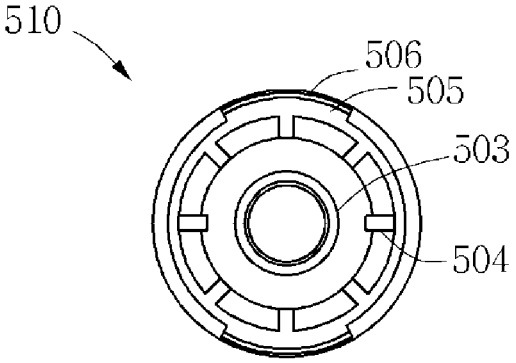
Figure 11C:
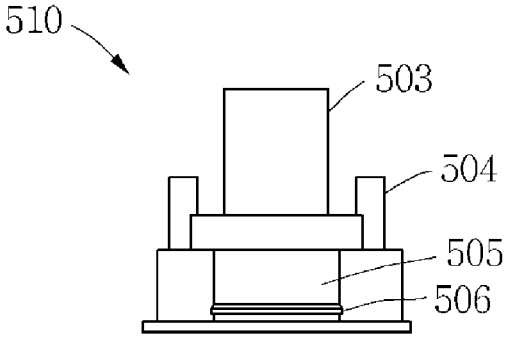

As shown in FIG. 11*c*, an upper end of a pipette 502 is coupled with an inner surface of the upper end of the cap thread part 501. Since the coupling structure and the coupling method of the pipette 502 are generally known in the art, the details thereof will be omitted.

Meanwhile, a cylindrical pumping tube 503 is formed with a predetermined length at an upper end of the coupling member 510 in a vertical direction, and a plurality of moving bars 504 vertically are protruded at a part of the upper end of the coupling member 510, which is spaced apart from the pumping tube 503 by a predetermined distance, in a circumferential direction of the coupling member 510 as shown in FIGS. 11*a*, 11*b*, and 11*c*.

Hereinafter, the structure of the button member 520 will be described with reference to FIGS. 5*a* to 10*d*.

Figure 10A:
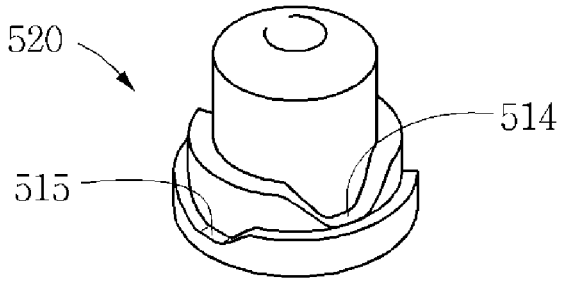
FIGS. 10*a* to 10*d* are views showing the structure of a button member according to the third embodiment of the present invention.
Figure 12:
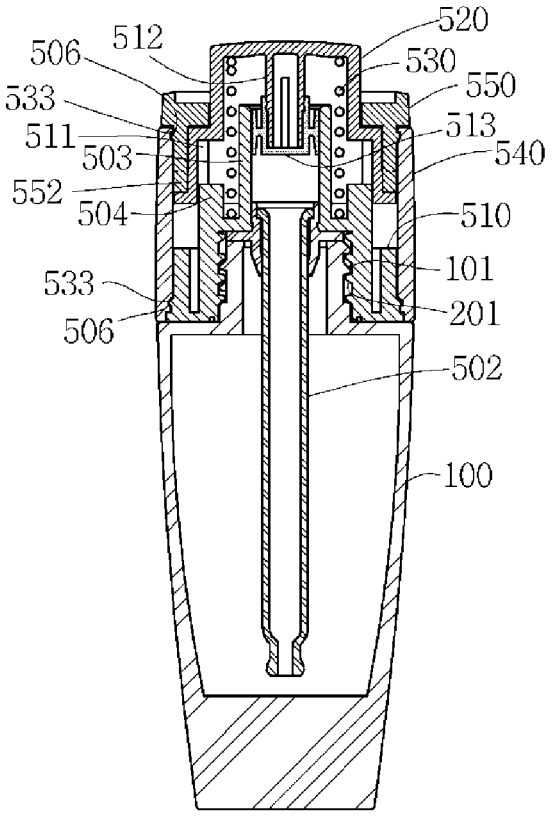
FIGS. 12 and 13 are views showing an adjusting member and a button member according to the third embodiment of the present invention.

As shown in FIG. 10*a*, the button member 520 has the form of a multi-staged cap, and is coupled with an upper portion of the coupling member 510 as shown in FIG. 12, so that the button member 520 is vertically moved up and down.

Figure 10B:
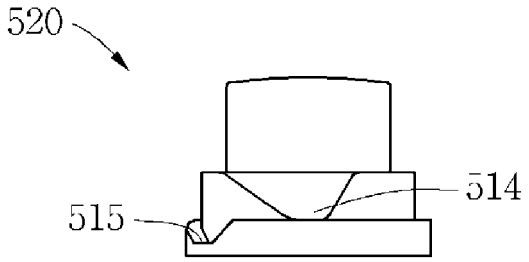
Figure 10C:
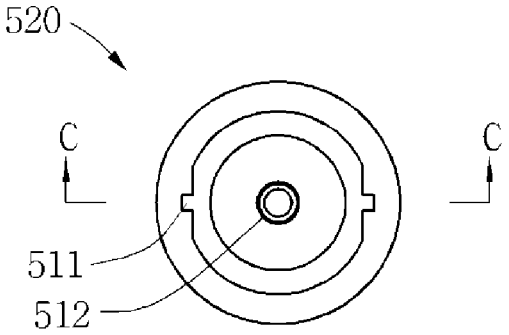
Figure 10D:
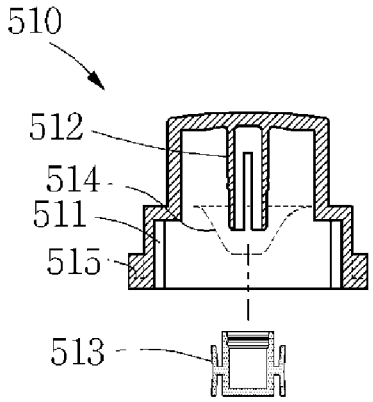

As shown in FIG. 10*d*, a pumping member 512 is protruded with a predetermined length downward from the bottom surface of the button member 520. A pumping part 513 is coupled with the lower end of the pumping member 512 while adhering to the inner surface of the pumping tube 503. Accordingly, if the button member 520 descends, the pumping part 513 descends in the state of the pumping part 513 densely makes contact with the inner surface of the pumping tube 503 while air is being discharged through an opening provided at the lower end of the pipette 502.

A plurality of moving grooves 511 used to insert the moving bars 504, which is provided at the upper end of the coupling member 510, therein is molded in the inner surface of the button member 520 in the circumferential direction of the button member 520 so that the moving grooves 511 correspond to the moving bars 504. Therefore, the moving bars 504 are inserted into the moving grooves 511, so that a guide to move up or down the button member 520 in a vertical direction is provided.

Figure 7:
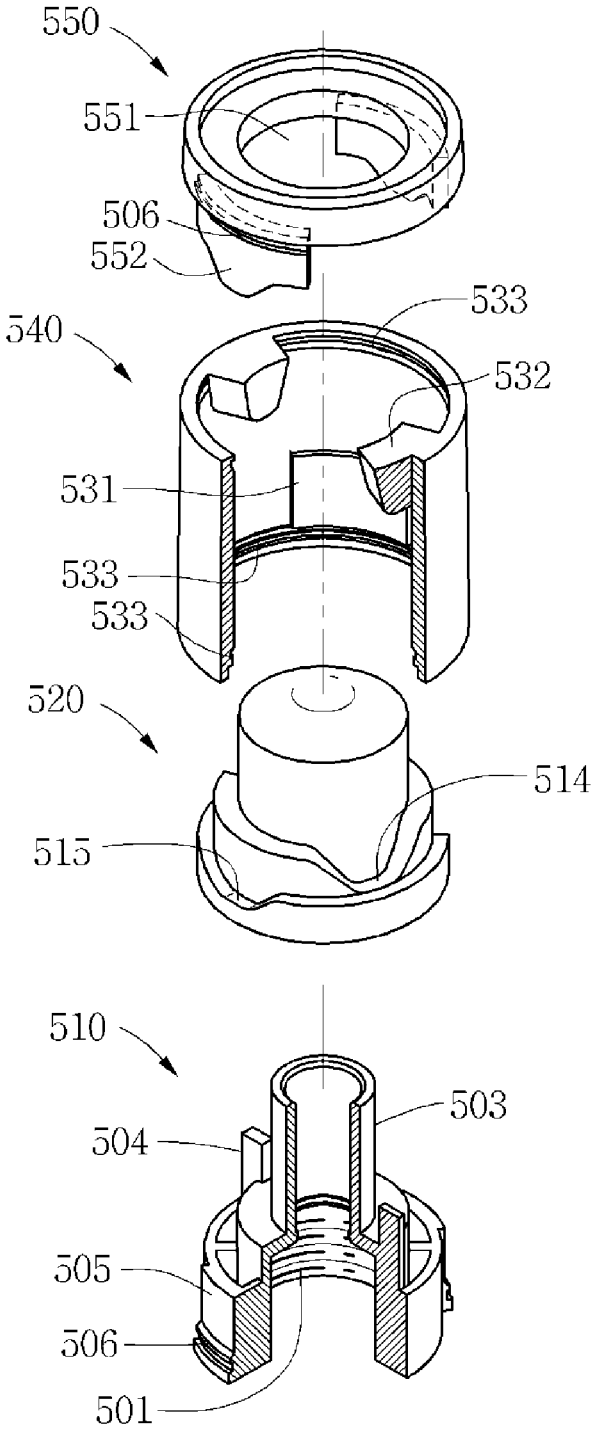
FIG. 7 is an exploded perspective view showing the whole structure of a cap of a cosmetic bottle according to a third embodiment of the present invention.

As shown in FIGS. 7 and 12, the elastic member 530 is interposed between the outer diameter of the pumping tube 503 of the coupling member 510 and the moving bars 504 to elastically support the button member 520.

Meanwhile, hereinafter, the structure of a rotating member 540 will be described with reference to FIGS. 9*a* to 9*c*.

As shown in FIG. 12, the rotating member 540 is rotatably coupled with an outside of the coupling member 510 and has the shape of a cylinder having a predetermined height.

Figure 9A:
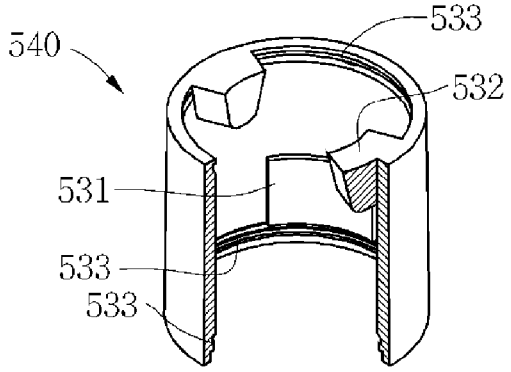
FIGS. 9*a* to 9*c* are views showing the structure of a rotating member according to the third embodiment of the present invention.
Figure 9B:
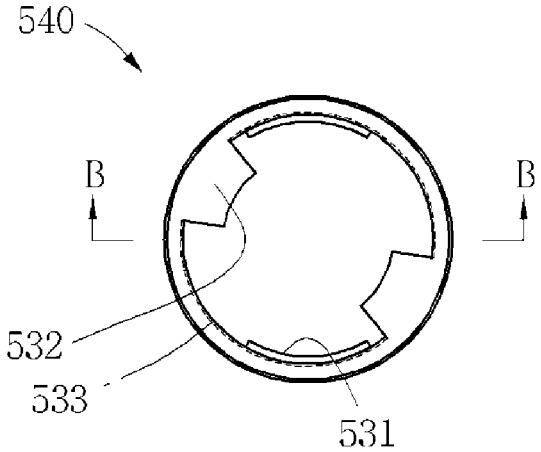
Figure 9C:
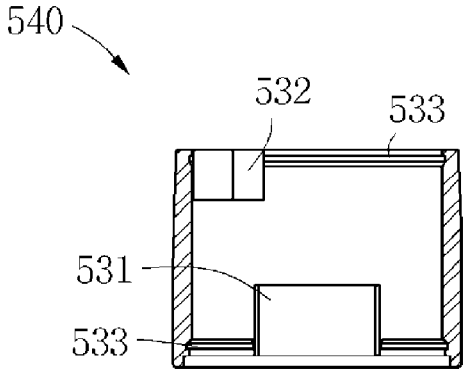

In addition, as shown in FIG. 9*a*, coupling grooves 533 are formed at upper and lower ends of the inner surface of the rotating member 540 in a circumference direction, and hooks 506, which are formed at a lower portion of the outer surface of the coupling member 510, are inserted into the coupling grooves 533 and coupled with the coupling grooves 533.

Figure 8A:
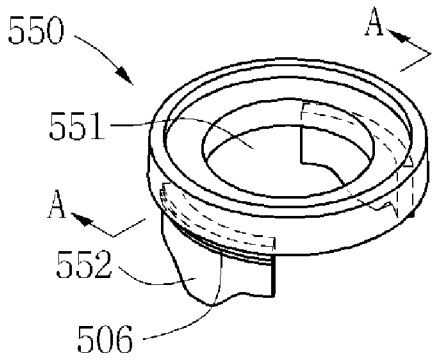
FIGS. 8*a* to 8*c* are views showing the structure of an adjusting member according to the third embodiment of the present invention.
Figure 8B:
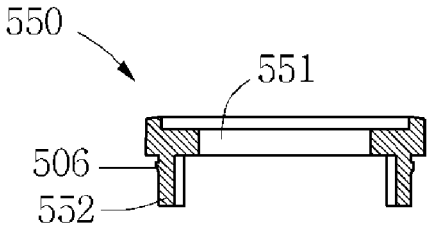
Figure 8C:
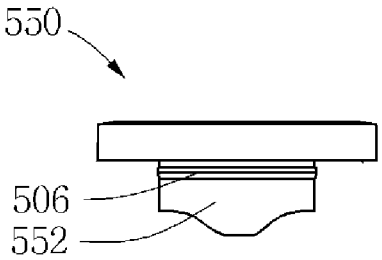

Meanwhile, hereinafter, the structure of the adjusting member 550 will be described with reference to FIGS. 8*a* to 8*c*.

As shown in FIG. 12, the adjusting member 550 is rotatably inserted into the inner surface of the upper end of the rotating member 540 and coupled with the inner surface of the upper end of the rotating member 540. The hooks 506, which are protruded at the lower portion of the outer surface of the adjusting member 550, are inserted into the coupling grooves 533 formed at the upper portion of the inner surface of the rotating member 540 and coupled with the coupling grooves 533. The adjusting member 550 is provided therein with a through hole 551 to allow the button member 520 to pass therethrough and prevents the button member 520 from being out of the through hole 551 by the elasticity of the elastic member 530.

Meanwhile, as shown in FIGS. 7, 11*a*, 11*b*, and 11*c*, a plurality of locking parts 505 are protruded on an outer surface of the coupling member 510, and a plurality of support parts 531 are protruded on an inner surface of the rotating member 540 as shown in FIGS. 7, 9*a*, 9*b*, and 9*c* so that the support parts 531 interfere with the locking parts 505. Accordingly, if the rotating member 540, which is rotatably coupled with the coupling member 510, is rotated at a predetermined angle, the support parts 531 interfere with the locking parts 505, so that the locking parts 505 and the coupling member 510 can be rotated.

The hooks 506, which are formed at the lower portion of the outer surface of the coupling member 510, are formed on an outer surface of the locking part 505 as shown in accompanying drawings, so that the coupling member 510 can be coupled with the rotating member 540. Accordingly, preferably, the rotation of the rotating member 540 can be performed within a predetermined angel range.

As shown in FIG. 9*a*, a plurality of adjusting protrusions 532 are protruded at an upper portion of an inner surface of the rotating member 540 in a circumferential direction, and each adjusting protrusion 532 has an inclined surface which has a predetermined angle and a sectional area gradually reduced downward.

In this case, preferably, a horizontal part connected with the inclined surface is smoothly rounded.

In addition, any one of end portions of the multi-staged button member 520 is provided therein with adjusting grooves 514 in a circumferential direction so that the adjusting protrusions 532 may be inserted into the adjusting grooves 514 corresponding to the adjusting grooves 514. The sectional area of the adjusting groove 514 is gradually reduced downward so that an inclined surface is formed in the adjusting groove 514, and, preferably, a horizontal part connected to the inclined surface is smoothly rounded.

Meanwhile, as shown in FIG. 7, and FIGS. 10*a* to 10*d*, any one of end portions of the multi-staged button member 520 is provided therein with adjusting grooves 515 similar to or the same as the adjusting grooves 514 so that an inclined surface is formed in each adjusting groove 515, and a horizontal part connected to the inclined surface is smoothly rounded. In addition, adjusting protrusions 552 are protruded downward from a bottom surface of the adjusting member 550 so that the adjusting protrusions 552 are inserted into the adjusting grooves 515 corresponding to the adjusting grooves 515. An inclined surface is formed by gradually reducing the sectional area of each adjusting protrusion 552 downward and a horizontal part connected to the inclined surface is smoothly rounded.

Hereinafter, the operation of the cap for the cosmetic bottle 100 having the above structure according to the present invention will be described with reference to accompanying drawings.

Figure 14:
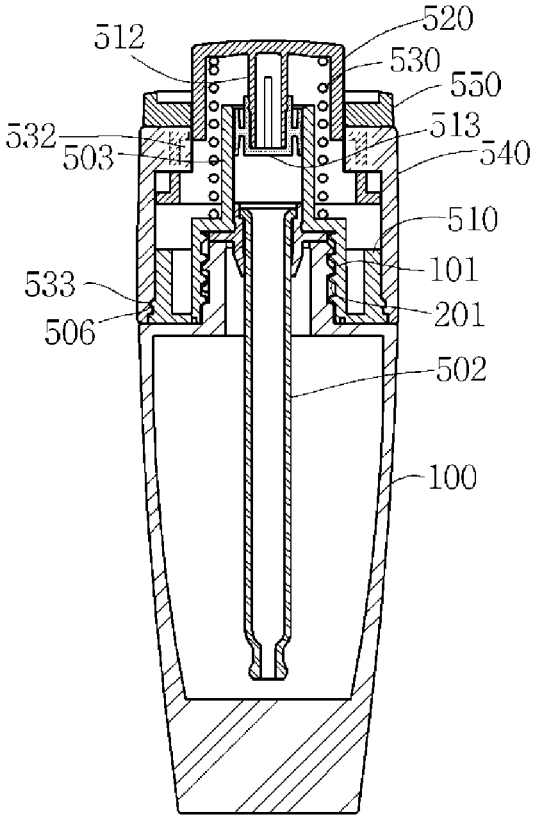
FIGS. 14 and 15 are views showing a rotating member and a coupling member according to the third embodiment of the present invention.
Figure 15:
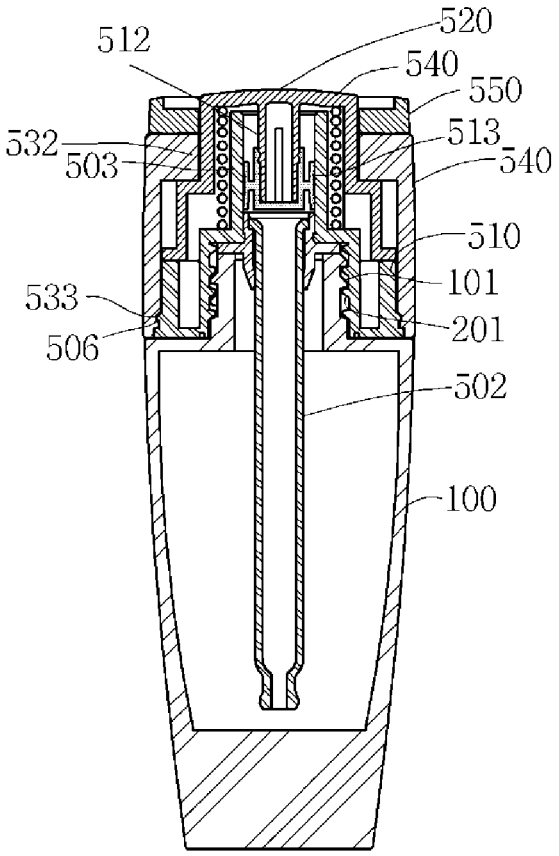

Hereinafter, a unit of outputting the button member 520 will be described in that the cap thread part 501 of the coupling member 510 is coupled to the bottle thread part 100*a* through the rotation manipulation of the rotating member 540, thereby closing the cosmetic bottle 100 while moving down and hiding the button member 520 as shown in FIGS. 14 and 15.

In other words, if the rotating member 540 is rotated clockwise, since the rotating member 540 has been coupled with the coupling member 510 by the coupling groove 533 and the hook 506, the coupling member 510 and the rotating member 540 are rotated together.

The coupling member 510 is more strongly affected by a coupling force resulting from the coupling groove 533 and the hook 506 rather than being free from the rotation of the rotating member 540. Accordingly, if the rotating member 540 is rotated, the coupling member 510 is rotated together with the rotating member 540 until predetermined physical force is applied to the coupling between the coupling member 510 and the rotating member 540.

Accordingly, if the rotating member 540 is rotated, the locking part 505 is rotated together with the rotating member 540, so that the cap thread part 510 is coupled with the bottle thread part 100*a*. Therefore, the cosmetic bottle 100 can be closed.

If the rotating member 540 is more rotated in the state that the cap thread part 501 of the coupling member 510 is completely coupled with the bottle thread part 100*a* of the bottle 100 as described above, the rotation of the coupling member 510 is stopped and maintained due to the complete coupling between the bottle screw part 100*a* and the cap thread part 501. In this case, since the force applied to the rotating member 540 by a user is greater than a coupling force between the coupling groove 533 and the hook 506, the rotating member 540 is rotated in the state that the coupling groove 533 is coupled with the hook 506.

Therefore, if the rotating member 540 is rotated, the support part 531 formed in the rotating member 540 is rotated. In this case, since the support parts 531 are spaced apart from each other by a predetermined distance as shown in FIGS. 9*a* and 9*b*, if the rotating member 540 is rotated at a predetermined angle, the support parts 531 interfere with the locking parts 505 of the coupling member 510 shown in FIGS. 11*a*, 11*b*, and 11*c*, so that the rotational force of the support parts 531 is transferred to the locking parts 505. Accordingly, the coupling member 510 having the locking parts 505 is rotated.

Figure 13:
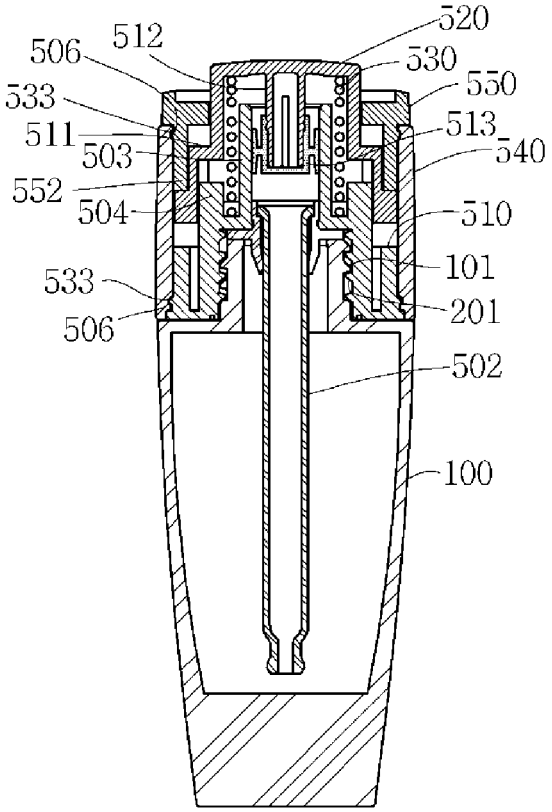

If the coupling member 510 is rotated by the support parts 531 of the rotating member 540 and the locking parts 505 of the coupling member 510 as described above, the moving bars 504 formed on the upper end of the coupling member 510 are rotated together with the coupling member 510. In this case, since the moving bars 504 have been inserted into the moving grooves 511 of the button member 520 as shown in FIGS. 10*c* and 13, the rotation of the coupling member 510 induces the rotation of the button member 520.

In this case, the adjusting grooves 514 are formed at the upper portion of the multi-staged button member 520 as shown in FIGS. 7, 10*a*, and 10*b*, and the adjusting protrusions 532 are formed at the upper portion of the inner surface of the rotating member 540 as shown in FIGS. 7 and 9*a* and inserted into the adjusting grooves 514. Accordingly, as the button member 520 is rotated, the adjusting protrusions 532 inserted in the adjusting grooves 514 obliquely slide along the inclined surface to move the upper portion of the end portion of the button member 520 as shown in FIG. 15.

In the process in which the bottom surface of each adjusting protrusion 532 is moved to the upper portion of the end portion of the button member 520, the button member 520 is moved down while rotating as shown in FIG. 15.

Therefore, when the cap is separated from the cosmetic bottle 100, the adjusting protrusion 532 of the rotating member 540 is continuously inserted into the adjusting groove 514 of the button member 520. In this case, the button member 520 is moved up to the upper portion of the rotating member 540 by the elasticity of the elastic member 530. In this state, if the user presses the button member 520, the button member 520 is moved down while pressing the elastic member 530, so that the pumping part 513 is moved down along the inner surface of the pumping tube 503, thereby discharging the liquid which has been sucked into the pipette 502.

Meanwhile, if the cap is coupled with the cosmetic bottle 100, even if a user does not press the button member 520, as the rotating member 540 and the coupling member 510 are rotated at a predetermined angle, the button member 520 is rotated at a predetermined angle by the moving bars 504 and the moving grooves 511. In this case, the adjusting groove 514, into which the adjusting protrusion 532 is inserted, slides along the inclined surface while the end portion of the button member 520 is moved to the bottom surface of the adjusting protrusion 532. Accordingly, the button member 520 is moved down by the depth of the adjusting groove 514 or the height of the adjusting protrusion 532, so that the pumping part 513 is moved down inside the pumping tube 503 in the state that the pipette is inserted into the bottle 100 while air is discharged. Simultaneously, the air inside the bottle 100 is compressed.

In contrast, when the cap is separated from the cosmetic bottle 100, the rotating member 540 is rotated counterclockwise. In this case, the support part 531 of the rotating member 540 is separated from the locking part 505 while interfering with another locking part 505, thereby rotating the coupling member 510 counterclockwise.

Therefore, the button member 520 is rotated counterclockwise by the moving bar 504 and the moving groove 511 of the coupling member 510. In this case, the adjusting groove 514 of the button member 520 is rotated toward the adjusting protrusion 532 positioned at the end portion of the button member 520, and the adjusting groove 514 of the button member 520 slides along the inclined surface of the adjusting protrusion 532 by the elasticity of the elastic member 530 while the adjusting protrusion 532 is inserted into the adjusting groove 514.

As a result, the adjusting protrusion 532 is inserted into the adjusting groove 514 so that the height difference is removed. Accordingly, the button member 520 is moved up. In this case, the pumping part 513 provided at the lower end of the pumping member 512 of the button member 520 is moved up in the state that the pumping part 513 densely makes contact with the inner surface of the pumping tube. Accordingly, a liquid can be sucked into the pipette.

Meanwhile, the present invention provides a technical mechanism in which the pipette 502 always sucks the constant amount of liquid by allowing a user to personally adjust the amount of liquid sucked into the pipette in addition to the unit of outputting the button member.

In other words, as shown in FIGS. 12 and 13, the adjusting member 550 coupled with the upper portion of the rotating member 540 is adjusted through rotation, thereby adjusting the ascending and descending distances of the button member 520. Since the adjusting groove 515, which is formed in any one of the multi-staged button member 520 as shown in FIGS. 7, 10*a*, and 10*b*, has a predetermined height and a width gradually reduced downward, an inclined surface is formed in the adjusting groove 515.

In addition, the adjusting protrusion 552 is protruded at the lower portion of the adjusting member 550 so that the adjusting protrusion 552 can be inserted into the adjusting groove 515 and the inclined surface of the adjusting protrusion 52 having a lower sectional area gradually reduced is formed so that the adjusting protrusion 552 can be smoothly inserted into the adjusting groove 515, and separated from the adjusting groove 515.

As shown in drawings, the hook 506 is formed on the outer surface of the adjusting protrusion 552 of the adjusting member 550, so that the hook 506 is coupled with the coupling groove 533 provided at the upper portion of the inner surface of the rotating member 540.

Therefore, the button member 520 always tries to move up by the elasticity of the elastic member 530. In this case, the button member 520 has passed through the through hole 551 of the adjusting member 550 and any end portion of the multi-staged button member 520 is molded greater than the size of the through hole 551, so that the button member 520 is confined by the through hole 551.

If the adjusting member 550 is rotated, the adjusting protrusion 552 is moved to the adjusting groove 515. At the same time, the adjusting protrusion 552 is naturally inserted into the button member 520 elastically supported by the elasticity of the elastic member 530 or the adjusting groove 515 of the button member 520, so that the button member 520 is moved up by the inserted depth of the adjusting protrusion 552 as shown in FIG. 12.

In contrast, when the adjusting protrusion 552 of the adjusting member 550 is not inserted into the adjusting groove 515, but placed on the end portion of the button member 520, the button member 520 is moved down by the depth of the adjusting groove 515 or the height of the adjusting protrusion as shown in FIG. 13.

Since the ascending distance or the descending distance of the button member 520 is adjusted by the insertion state of the adjusting protrusion 552 into the adjusting groove 515, a distance in which the pumping part 513 is moved down and then moved up is determined. Accordingly, the amount of the liquid sucked into the pipette 502 is determined.

Therefore, if a user determines that the amount of cosmetics sucked into the pipette is greater than the amount of cosmetics to be used once, the user rotates the adjusting protrusion 552 to separate the adjusting protrusion 552 from the adjusting groove 515 and place the adjusting protrusion 552 on the end portion of the button member, thereby reducing the amount of cosmetics sucked into the pipette. In addition, if the user manipulates the adjusting protrusion 552 to insert the adjusting protrusion 552 into the adjusting groove 515, the amount of cosmetics sucked into the pipette is increased. Accordingly, the user can personally set the amount of cosmetics to be used once.

What is claimed is:

1. A cap for a cosmetic bottle, comprising:

an opening or closing member including a bottle coupling part having an inner surface and provided thereon with a thread part so that the thread part is configured to engage with an upper end of the cosmetic bottle, and a body coupling part upwardly erected with a predetermined height after extending by a predetermined distance from an outer circumference of a lower end of the bottle coupling part;

an adjusting member rotatably coupled with an upper end of a cylindrical body coupled with an outer surface of the body coupling part and having an upper end provided therein with a second through hole;

a press button inserted from a lower portion of the second through hole to an upper portion of the second through hole so that the press button is exposed;

an elastic member provided onto an outer surface of the bottle coupling part to support a bottom surface of the press button;

a cylinder provided in an outer circumference surface of a lower portion thereof with a coupling groove fitted around an inner circumference part of a first through hole and provided in a lower portion of an inner circumference surface thereof with a fitting groove;

a guide rod protruded downward from the bottom surface of the press button;

a piston coupled with a lower end of the guide rod to make contact with the inner circumference surface of the cylinder;

a pipette having a tubular structure and having a fitting protrusion protruded on an outer surface of an upper end of the pipette and fitted into the fitting groove of a pumping tube; and an adjusting unit of the press button to adjust an ascending distance or a descending distance of the press button, wherein the adjusting unit of the press button comprises a support part including a plurality of horizontal support steps, which are protruded in a circumferential direction on an outer circumference part of a lower portion of the press button and spaced apart from each other by a predetermined distance, each of the plurality of horizontal support steps having a predetermined height, and a support guide inclined at a predetermined angle and connecting the plurality of support steps to each other; and wherein the adjusting member comprises a locking part including a plurality of horizontal locking steps, which are protruded in the circumferential direction on a lower portion of the second through hole of the adjusting member and spaced apart from each other by a predetermined distance, each of the plurality of horizontal locking steps having a predetermined height, and a locking guide inclined at a predetermined angle and connecting the plurality of locking steps each other, and wherein the locking part is configured to be engaged with an upper portion of the support part of the press button.

* * * * *